United States Patent [19]

Khoo et al.

[11] 3,956,095

[45] May 11, 1976

[54] SACRIFICIAL ANODE

[75] Inventors: Sian Wah Khoo, Etobicoke; Ranald L. Hay, Caledon East, both of Canada

[73] Assignee: Canadian Gas Association, Don Mills, Canada

[22] Filed: July 31, 1974

[21] Appl. No.: 494,001

[30] Foreign Application Priority Data

Apr. 30, 1974 Canada ..... 198953

[52] U.S. Cl. ..... 204/197; 204/56 M; 204/148; 204/290 R

[51] Int. Cl.[2] ..... C23F 13/00; C25D 11/30

[58] Field of Search ..... 204/56 M, 148, 197, 204/290 R

[56] References Cited

UNITED STATES PATENTS

| | | | |
|---|---|---|---|
| 1,923,502 | 8/1933 | Prier | 204/56 M |
| 2,880,148 | 3/1959 | Evangelides | 204/56 M |
| 2,926,125 | 2/1960 | Currah et al. | 204/56 M |
| 3,732,152 | 5/1973 | Hawke | 204/56 M |
| 3,739,456 | 6/1973 | Scherer et al. | 204/197 |
| 3,887,449 | 6/1975 | Baer | 204/148 |

*Primary Examiner*—T. Tung

*Attorney, Agent, or Firm*—Rogers, Bereskin & Parr

[57] ABSTRACT

This invention is directed to an improved sacrificial anode which consists of a magnesium or magnesium alloy core having a porous magnesium coating thereon. It is also directed to a method of preparing the anode including etching the anode surface, anodizing the anode for about 10 minutes in a solution of an electrolyte at a current density in the range of 10MA/cm$^2$ to 50MA/cm$^2$ using direct current at room temperature, subsequently reversing the current for about 5 minutes, allowing the anode to remain in the electrolyte for a period of about 30 seconds in the absence of current, re-anodizing the anode for about 10 minutes, again reversing the current for about 5 minutes and allowing the treated anode to remain in the electrolyte for a period of about 5 minutes in the absence of current. This results in an improved anode which gives better protection for structures such as water heaters.

3 Claims, No Drawings

SACRIFICIAL ANODE

The present invention relates to an improved sacrificial anode for use in cathodic protection and to techniques employed in the conditioning of the anode surfaces in order to make the anode material more effective in such cathodic protection.

More specifically, the present invention is directed to sacrificial anodes used in the cathodic protection of water heaters. It may, however, be extended to include cathodic protection associated with the sacrificial anodes of buried and immersed structures such as pipelines, storage vats, oil and water tanks, condenser boxes, ships and various other applications.

Cathodic protection systems in which a metal immersed in an electrolyte is protected from corrosion by means of a sacrificial anode which is also immersed in the electrolyte and electrically connected to the cathodic surface to be protected are well known. Sacrificial anodes comprise a metal which is anodic to the metal surface to be protected and a means, such as a rod or cable, to attach the anode to the surface to be protected. When the anode and cathodic surface are in the electrolyte and are electrically connected, the resulting flow of current causes corrosion to occur at the anode but greatly reduces the rate of corrosion of the cathodic surface.

Sacrificial anodes of magnesium are the most common because they possess a high driving potential, a favourable electrochemical equivalent, are easily fabricated and are readily available. These anodes generally have an iron core surrounded by magnesium or by the alloy. Magnesium does however, suffer from the drawback that it is subject to irregular wastage. Preferential wastage occurs near the edges of the electrode and on impurity sites which result from surface contaminants and metallurgical flaws. After localized corrosion of magnesium begins, deep cavities form which trap the products of corrosion. Anions present in the water, such as sulphates and chlorides, attack the magnesium exposing more anode surface and forming tiny localized concentration cells with the cathodic particles. As a result, the rate of penetration and the accompanying wastage accelerates in areas where cavities are first formed.

In practice, magnesium anodes or anodes of magnesium alloys containing at least about 90% magnesium which are intended to last for 10 years in water heaters, sometimes dissipate within weeks in the presence of adverse factors such as high operating temperatures, a high conductivity electrolyte, proximity to more noble elements and a multitude of microscopic cavities due to flaws and surface contaminants. Such an overactive anode will protect the system for only a limited period and corrodes to such an extent that its effectiveness is reduced. Thus the cathodic surfaces are vulnerable to attack since they are not sufficiently polarized. The attendant consequences are premature tank leaks in the case of water heaters. Additionally, an overactive anode can produce excessive gassing, odour in waters, and, because they form centres for the agglomeration of calcium, hardness salt particles are formed. Such as anode may also produce an increased bumping tendency and a release of corrosive substances into the solution formed by the decomposition of the magnesium salts. Stabilization of bumping is achieved by a reduction of solid formation, a reduction of gas evolution and more even heat distribution.

Previously known methods of preventing or reducing excessive magnesium anode wastage include covering all but one end of the magnesium or magnesium alloy anode with a sheath made essentially of aluminum, which is a more noble metal than magnesium, or with an aluminum base alloy to reduce the rate of reaction of the anode with the electrolyte. Under certain conditions, the sheath may form an insulating layer of oxide which can prevent current delivery in low conductivity waters. Another known method consists of surrounding the anode with a closely fitted coating of electrically insulating liquid-impervious plastic material, the coating containing perforations adjacent to at least one surface of the anode body. However, trapped corrosion products between the plastic sheath and the anode surface may in some instances exert sufficient force to cause the sheath to bulge thereby allowing entry of the electrolyte. This results in intensified corrosion in local areas. The installation of an electrical resistance to regulate wastage has also been used but this is not completely effective since the secondary chemical reaction between the magnesium and the electrolyte is not abated. Thus, while these methods are effective to at least some degree in reducing anode wastage, they result in much more expensive anodes and have not been widely used.

For these reasons, a modified magnesium or magnesium alloy anode has been developed which reduces localized corrosion due to formation of the above-described localized concentration cells. This is achieved primarily by the removal of surface contaminants from the anode and by polarizing it to form a porous oxide film. This protective layer also acts as a sheath and reduces the current delivery, thereby increasing the current efficiency, without impairing the protective efficiency of the anode. In a low conductivity medium, the enhanced surface area of the porous oxide film renders the anode more effective and hinders the formation of an insulating film.

The porous oxide film has been developed by a judicious choice of electrolyte for polarizing the anode, suitable operating parameters involving the appropriate current density, voltage, temperature, cell arrangement during anodizing, appropriate etching treatment and most crucially a combintion of techniques involving re-anodizing, transient cathodic polarization during intervening periods and subsequent growth consolidation of the porous oxide film by immersing the treated magnesium connected to the cathode in the forming electrolyte for a limited time without impressed current, to produce anode material with desireable characteristics.

In order to prepare the improved sacrificial anode of the present invention, the anode is first etched to remove all surface impurities. This may be accomplished in a manner which will be well known to one skilled in the art. One such method is the use of a mixture of sodium nitrate and acetic acid. It has been found that omission of the etching step results in films with poor adhesion and which are heavily contaminated.

The anode is subsequently anodized for a period of about 10 minutes in a solution of an electrolyte selected from the group of ammonium tartrate and sodium borate. A preferred solution is an ammonium tartrate solution (about 0.25% W/V at a current density of $10MA/CM^2$–$50MA/CM^2$, depending upon the size of the electrode, under direct current conditions and at room temperature with a large stainless steel vessel which serves as a cathode. Table 1 shows the results obtained when using various electrolytes.

TABLE I

| | Electrolyte | Anodising Voltage(v) | Minimum Initial | Current Delivery(mA) after 1st decay | after 2nd decay | Appearance of film |
|---|---|---|---|---|---|---|
| 1. | Ammonium Tartrate | 35 | 120 | 11 | 6 | rough, uniform |
| 2. | Ammonium Citrate | 30 | 120 | 135 | 41 | thin, smooth |
| 3. | Ammonium Oxalate | 36 | 120 | 38 | 14.5 | streaky |
| 4. | Boric Acid | 77 | 27 | 25 | 15 | very poor |
| 5. | Tartaric Acid | 60 | 115 | 275 | 65 | patchy |
| 6. | Citric Acid | 75 | 100 | 100 | 100 | practically no film |
| 7. | Sodium Borate | 55 | 58 | 13 | 6 | rough, uniform |

The electrical leads are subsequently reversed and cathodic polarization is allowed to occur for a period of about 5 minutes. The anode is left in the electrolyte for a period of about 30 seconds in the absence of current. The approximate 10 minute anodization and approximate 5 minute cathodic polarization process is repeated and finally the porous oxide film is allowed to consolidate then the power source is removed and the treated anode, connected to the cathode, is left in the forming electrolyte for about 5 minutes. The electrolyte in the vessel may subsequently be replaced by tap water of medium hardness in order to further consolidate the oxide film but excessive formation of carbonate under certain circumstances may be detrimental.

Typical voltages used during the oxidation and cathodic polarization processes are in the range of about 40 volts. These processes are not normally carried out at an elevated temperature.

In order to produce more compact films it is necessary to repeat the anodic and cathodic polarization steps. However, if the sequence is repeated the procedure becomes too protracted and uneconomical.

The following example will serve to illustrate the formation of an improved sacrificial anode according to the present invention.

EXAMPLE I

Two magnesium anodes having a length of 33 inches and two magnesium anodes having a length of 4½ inches were etched in a solution of sodium nitrate and acetic acid. The etched anodes were then anodized in a solution of ammonium tartrate having a conductivity of about 1850 micromho/cm. Two 3 inch wide strips of stainless steel 24 inches apart were used as cathodes and the anodes were positioned midway between the cathodes. The current delivery source was a DC welder. The anodization was continued for 10 minutes at 7 amps and 35 volts. The polarity was reversed and the cathodic process was continued for 5 minutes at 5 amps and 35 volts. The current density was approximately 10MA/CM². At the end of each stage the anode and cathode leads were connected to a milliameter to monitor the current delivery in the electrolyte. At the end of the cathodic stage the anode was left connected to the cathode with the DC supply switched off for a period of about 30 seconds. The current measured indicates the degree of compactness of the film. The anodic, cathodic and current decay stages were repeated to reinforce a compact film but in this instance a period of about 5 minutes was allowed for the current decay stage. Table II gives the current values take at each stage of the treating process.

TABLE 2

| ANODE | BEFORE ANODISING | AFTER 1st ANODISING | AFTER 1st CATHODIC TREATMENT | AFTER 2nd ANODISING | AFTER 2nd CATHODIC TREAT-MENT & FINAL CURRENT DECAY |
|---|---|---|---|---|---|
| Long Specimen No. 1 | 91 | 120 | 23 | 80 | 12 |
| Long Specimen No. 2 | 135 | 183 | 195 | 83 | 3.5 |
| Short Specimen No. 1 | 37 | 33 | 0.40 | 39 | 0.30 |
| Short Specimen No. 2 | 48 | 32 | 0.45 | 39 | 0.30 |

Comparative tests were carried out between treated and untreated anodes from the same stock in a wide variety of waters. The following examples illustrate the results of some of these tests.

EXAMPLE II

Current and potential measurements were taken with a zinc probe in a water heater containing distilled water of conductivity 60 micromho/cm at 0 psi., 140°F. The results are shown in Table 3:

TABLE 3

| ANODE | CURRENT IN MA | POTENTIAL IN V. OF HEATER UNIT WITH RESPECT TO ZINC PROBE Top | Center | Bottom |
|---|---|---|---|---|
| treated | 1.2 | −0.64 | −0.70 | −0.46 |
| treated | 1.1 | −0.59 | −0.64 | −0.40 |
| untreated | 0.8 | −0.35 | −0.45 | −0.35 |
| untreated | 0.8 | −0.36 | −0.41 | −0.36 |

The treated anodes give more current and better potential and this would appear to be due to the porous structure of the film in the outer region and inhibition of the formation of an insulating layer which stifles current decay. Over a long period, the potential of the iron measured in the presence of an untreated anode rose to above 0.3V with respect to zinc, while the treated anode still gave negative potentials. The datum level for adequate protection of the steel structure is +0.3V. with respect to high purity zinc, i.e. values more negative indicate a greater protective efficiency. This indicates that the normal anode tends to lose its protective efficiency with time while the treated anode maintains its protective efficiency.

EXAMPLE III

Current and potential measurements were taken with a zinc probe in a water heater containing water having chlorides and sulphates therein which has been softened using a typical domestic water softner (conductivity of about 1000 micromho/cm) at 0 p.s.i., 140°F. The chloride and sulfate content of the softened water were regulated to give a conductivity of about 1000 micromho/cm by the addition of sodium chloride and sodium sulfate. The results are shown in Table 4.

TABLE 4

| ANODE | CURRENT IN MA | POTENTIAL IN V. OF HEATER UNIT WITH RESPECT TO ZINC PROBE | | |
|---|---|---|---|---|
| | | Top | Center | Bottom |
| treated | 26.0 | −0.44 | −0.45 | −0.42 |
| untreated | 36.0 | −0.52 | −0.56 | −0.52 |

It can be seen that the treated anode protects the tank as satisfactorily as the normal anode. The current drop in this case is of no consequence for it is well known that the current generated is, in certain cases, greater than that required for adequate protection. The galvanic current must be great enough to protect the tank and yet not so great as to consume the anode at an excessive rate. As long as the potential of the heater unit with respect to the zinc probe is less than about +0.3V., the anode provides adequate protection. On inspection, the wastage of the treated anode is more uniform than the untreated anode. In higher conductivity media, the difference between anode weight loss which was observed in this test is even more pronounced with time. In one extreme example, the weight loss of the untreated anode was six times that of the treated anode after continuous exposure to the aggressive solution for a period of 1 month.

EXAMPLE IV

Current efficiency tests were conducted on treated and untreated anodes and Table 5 shows typical results for such tests:

TABLE 5

| ANODE | WT. LOSS(gm) | AMP. HOUR | AMP. HOUR/lb. |
|---|---|---|---|
| untreated | 9.143 | 8.55 | 425 |
| treated | 6.743 | 6.98 | 471 |

Thus, the treated anode is about 10% more efficient than the untreated anode in terms of current efficiency.

When evaluating the anodes in the above test the anode was insulated from a cathodic iron nipple at the centre but was connected externally to it by a single copper conductor. The cathode was cleaned using hydrochloric acid. A highly accurate current measuring device having a clamp-on probe was used to measure the current going through the copper conductor. The current delivery from the anodes was measured at regular intervals on the treated and untreated anodes in turn. Between these measurements, continuous readings were made by connecting a milliameter to a recorder.

The test solution used in these evaluations was a solution of salt in dilute hydrochloric acid to which some hydrogen peroxide has been added. The original pH was 4.5 and the pH increased progressively until the following day when it was 10. The solution was changed at that time. The strength of the solution was adjusted so that the current rating on the bare anodes was maintained at about 1 amp/sq.ft. to prevent overloading with consequent spalling of the anode material. The test was terminated when more than 30% of the bare anode was wasted. The anode weight loss and current deliveries were computed to establish the relative anode performance between the treated and untreated anodes as shown above.

Further, in the above tests and in other tests performed, it was found that the iron cathode to which the treated anode was connected was better protected than that of the untreated anode as reflected by the reduced number of rust nuclei on the surface.

The treated anode evolves considerably less gas than an untreated anode in most environments when immersed in an isolated state. The treated anode also appears to be more resistant to transient aggressive solutions such as those derived from the brine regenerant of water softners.

It is apparent from the foregoing that treated anodes possess merits over the untreated anodes and may be used in areas under diverse conditions where anode wastage has been a constant problem. A surprising feature of the treated anode is that it functions better than the untreated anode in both high and low conductivity waters which are corrosive.

The film on the treated anode is microporous in nature with an inner compact layer the extent of which is dependent on the alloy composition. The film is largely oxide in character. The different forming electrolytes give rise to films with different properties by virtue of the structural features of the film. The morphology of the films formed in the preferred ammonium tartrate electrolyte is such that, in high conductivity solutions, the oxide sheath regulates wastage by reducing both chemical reactions and localized attack. The oxide sheath, therefore, offsets the factor of increased wastage due to exposure of greater area because of the microporosity of the film. In low conductivity solutions, the morphology of the film on the treated anode produces more current flow. Increasing the aluminum content of the alloy will improve the film resistance because of the formation of compact barrier layers in the pore intersticies. Similarly, the incorporation of suitable alloying constituents in correct proportions can promote better film formation by producing the desired type of film. In the case of cathodic protection with sacrificial anodes, the film must not be too insulating, otherwise it will be inert in certain media.

What we claim is:

1. An anode consisting of magnesium or magnesium alloy having a porous magnesium oxide coating thereon formed by (1) etching the surface to remove all surface impurities, (2) anodizing the anode for approximately 10 minutes in a solution of an electrolyte selected from the group of ammonium tartrate and sodium borate, at a current density of 10 MA/cm$^2$ to 50 MA/cm$^2$ using direct current at room temperature with a stainless steel cathode. (3) then reversing the current for about 5 minutes, (4) then allowing the anode to remain in the electrolyte for a period of about 30 seconds in the absence of any applied voltage, (5) anodizing again for a period of about 10 minutes, (6) then reversing the current again for about 5 minutes and (7) then allowing the treated anode to remain in the electrolyte for about 5 minutes in the absence of any applied voltage, said coating reducing the current delivery in high conductivity waters without impairing the protective efficiency of the anode.

2. An anode as claimed in claim 1, in which the anode is formed of magnesium.

3. An anode as claimed in claim 1, in which the anode is formed of a magnesium alloy.

* * * * *